United States Patent [19]

Asinovsky et al.

[11] 4,295,021

[45] Oct. 13, 1981

[54] ELECTROMAGNETIC ARC EXTINCTION APPARATUS FOR SWITCHGEAR

[76] Inventors: Erik I. Asinovsky, 16 Parkovaya ulitsa, 49, korpus 1, kv. 78; Anatoly A. Afanasiev, Ljubertsy, ulitsa Shosseinaya, 10, kv. 137; Evgeny P. Pakhomov, Yakhromskaya ulitsa, 3, korpus 2, kv. 30; Vladimir A. Zeigarnik, Bolshoi Tishinsky pereulok, 41, kv. 9, all of Moscow; Ivan M. Yartsev, ulitsa Teatralnaya, 27, korpus 3, kv. 28, Dolgoprudny, Moskovskaya oblast, all of U.S.S.R.

[21] Appl. No.: 4,669

[22] Filed: Jan. 19, 1979

[51] Int. Cl.[3] ..... H01H 33/06

[52] U.S. Cl. ..... 200/147 R; 200/144 R

[58] Field of Search ..... 200/147 R, 144 R

[56] References Cited

U.S. PATENT DOCUMENTS 2,051,478 8/1936 Hampton et al. ..... 200/147 R 2,446,027 7/1948 Scott, Jr. ..... 200/147 R 2,648,744 8/1953 Strom et al. ..... 200/147 R

FOREIGN PATENT DOCUMENTS 1100959 4/1955 France ..... 200/147 R

*Primary Examiner*—Robert S. Macon

*Attorney, Agent, or Firm*—Steinberg & Raskin

[57] ABSTRACT

An electromagnetic arc extinction apparatus for switchgear comprises an arc chamber made of an electrically insulating material and having an axial channel. There are two electrodes arranged in axial relationship to the axis of the arc chamber and adapted to form a quenching arc having a helix-like shape. To provide for its movement in a radial direction, the quenching arc has the form of a helix whose pitch is at least 10 times lesser than the diameter of the arc chamber measured over its cross-section. In the apparatus of the invention, the helix of the quenching arc has a small pitch with the result that the associated switchgear offers small overall dimensions and can handle high voltages.

9 Claims, 9 Drawing Figures

ELECTROMAGNETIC ARC EXTINCTION APPARATUS FOR SWITCHGEAR

BACKGROUND OF THE INVENTION

1. Field of the Invention

The invention relates to switchgear in which a quenching arc is formed between electrodes, namely, to electromagnetic switchgear using magnetic blast which provides for the lengthening of the quenching arc when the arc column is acted upon by the force resulted from electromagnetic interaction between the arc current and a magnetic field. In particular, the invention relates to electromagnetic arc extinction apparatus used in switchgear.

The apparatus of the invention is suitable for use on any desirable alternating- or direct-current circuits and can find use in high-voltage heavy-current switchgear including circuit breakers, fuses and electroexplosion trips.

2. Description of the Prior Art

A quenching arc occurring in switchgear can be extinguished by recovering the arc voltage up to that existing across the contacts of the circuit being switched.

It is known that the breaking arc voltage is given by $U=El_1+\Sigma U_N$, where E is the intensity of the electric field in the arc column, $l_a$ is the length of the quenching arc, and $\Sigma U_N$ is the sum of the voltage drops at the electrodes. There are therefore three methods by which the arc voltage can be increased: increasing the number of voltage drops at the electrodes; increasing the intensity of the electric field in the arc column; and lengthening the quenching arc.

During the switching of alternating-current circuits, the arc can be extinguished (the electric strength of the interelectrode gap can be restored) at current zero in an alternating-current circuit. This feature can be used effectively in the case of vacuum-type circuit breakers which are being developed on a wide basis at the present time.

Increasing the number of voltage drops at the electrodes is basically applicable to low-voltage switchgear. In this case, the quenching arc is split into a number of series-connected smaller arcs each of which has its own voltage drop at the anode and cathode. Since the sum of these voltage drops does not usually exceed several tens of volt this method is used as an auxiliary one in the case of high-voltage switchgear.

At present, the method of increasing the intensity of the electric field in the arc column is basically suitable for high-voltage applications where U exceeds 10 to 20 kV. The method can find use in a.c. oil, small oil volume, air-blast and $SF_6$-filled circuit breakers. For these voltages, a.c. circuit breakers rated for higher parameters act as d.c. circuit breakers.

In these apparatus, the intensity of the electric field in the arc column is increased in a manner that the arc column is subjected to longitudinal, lateral or radial/-longitudinal blast using the working gas (compressed air or sulphur hexafluoride gas) or the products obtained during the decomposition of the working liquid (oil). In this case, the intensity E is equal to hundreds or thousands of V/cm, the spacing between the electrodes amounts to several tens of centimeter, the arc length $l_1$ reaches one to two meters, and a maximum turn-off voltage for one pair of electrodes reaches a value of 100 to 300 kV. However, the disadvantage of the apparatus is that they have a low switching time, $\tau$, which is usually equal to 0.2 to 0.06 s. In the latest embodiments, attempts are made to attain 0.02 s switching time by using sulphur hexafluoride gas.

Another disadvantages of the described apparatus are concerned with large dimensions and weight and with sophisticated design and laborious maintenance. Indeed, oil is fire-hazardous, air must be compressed, and $SF_6$ gas requires that the construction be hermetically sealed.

The lengthening of the quenching arc basically applies to electromagnetic switchgear in which case an arc is caused to move under the action of the force F resulted from electromagnetic interaction between the arc current and a magnetic field, that movement being performed over diverging (horn-shaped) electrodes and accompanied by a lengthening of the arc. The magnetic field is formed by external sources such as arc-quenching coils or the magnetic field of the arc current itself is employed.

Electromagnetic switchgear offers simple design features and good reliability, allows for multiple switching of circuits, does not require special working medium and provides for a higher operational speed that is increased with an increase of the current being interrupted, which makes this switchgear current-limiting during the interruption of short-circuit currents. Finally, with electromagnetic switchgear a.c. and d.c. uses are possible.

The switching time $\tau$ of electromagnetic switchgear is determined by the distance a covered by the arc column when it is moved in a direction of the driving force F, and is also determined by the velocity $V_a$ which is dependent upon the force F and upon the conditions under which the arc column is moved. Therefore, $\tau=a/V_a$. In the case of a flat arrangement of the arc, its length may exceed the value of a several times at most. For example, $l_a=\pi a$ if the arc is a semicircular one. With $l_a\tau U/E$, a relationship between the switching time $\tau$ and the turned-off voltage U in the case of electromagnetic switchgear is given by $\tau=U/kEV_a$ where $k=l_a/a$ is the proportionality coefficient to relate the arc length and the path covered by the arc column, this coefficient being dependent upon the arc shape. In the case of a freely moving arc, the intensity E is dependent upon the arc velocity and current and is usually equal to 10 to 100 V/cm. With $U=10$ kV at $V_a\approx 50$ m/s, $E\approx 30$ V/cm and $k=\pi$, the switching time $\tau$ becomes equal to 0.02 s, which gives the overall size of the arc extinction apparatus equal to $2a\approx 2$ m.

To reduce the overall size of the arc extinction apparatus and provide for better operating conditions and good arrangement of its components, electromagnetic switchgear is usually provided with an arc chamber which is a slit-shaped structure formed from plates made of electrically insulating material. The arc chamber operates to form the quenching arc and to determine the direction of its movement, provides for an increase the intensity of the electric field in the arc column by compressing and cooling the latter, and makes it possible to utilize magnetic circuits that help enhance magnetic blast. When a labyrinth (zigzag-like) slit is used the quenching arc can be lengthened additionally. However, the length of the arc can be increased using a labyrinth arc chamber only several times since the force F responsible for the movement of the arc column is decreased in this case with the result that switchgear is given a lower response.

To interrupt currents that are smaller in comparison to the rated current magnitude and that therefore result in a decrease in the effectiveness of magnetic blast, electromagnetic circuit breakers are usually provided with a self-blast air system.

Labyrinth arc chambers made it possible to develop electromagnetic circuit breakers rated, for example, for 10 to 20 kV and having the overall size of 1 m approximately and the switching time not exceeding 0.06 s. However, electromagnetic circuit breakers cannot find use at the present for switching higher voltages since their dimensions would become too large in this case along with a decreased switching time which is an important parameter of a circuit breaker.

The range of working voltages handled by electromagnetic circuit breakers can be increased by virtue of a helix-shaped breaking arc, the helix having a small value of the pitch λ.

Known in the art is a circuit breaker utilizing a helix-shaped quenching arc (cf. J. Miyachi, H. Naganawa, Spiral Arc in $SF_6$ Facilitating DC Interruption, III International Conference on Gas Discharges, London, 1974, p. 521). In this circuit breaker, a free straight arc is formed between electrodes closed by a wire after the latter is exploded electrically or after the parting of the electrodes in an axial direction. The arc surrounded by a magnetic field applied in a longitudinal direction relative to the electrodes axis takes the form of a helix that expands in a radial direction and the voltage across the electrodes tends to rise in this case. However, the helix features a nonregular form due to the presence of a large number of random distortions of very diversified shapes and dimensions. This results in a condition where certain portions or turns of the arc column are caused to converge and a breakdown therefore takes place with the result that a sudden decrease in the voltage across the electrodes occurs, while the portions of the arc column brought together are shunted and disintegrated. This phenomenon basically applies to small-scale distortions of the arc column which tend to develop at a greater rate.

This arc is therefore difficult to utilize; a ratio between the arc length and the electrode spacing amounts to 10 to 12 with the arc diameter of 4 to 6 cm and the helix pitch of 3 cm approximately.

There is an arc extinction apparatus for switchgear (cf. German Pat. No. 330,268, cl. 23c $35^{05}$, 1919), which apparatus comprises two electrodes adapted to produce a quenching arc in the the from of a helix that expands in a radial direction.

In the described apparatus, the electrodes are mounted on a cylinder member made of an electrically insulating material and are bent to take the form of a helix. To protect the electrode turns from breakdown, the cylinder member has a helix-shaped partition made of an electrically insulating material and having the value of the pitch of its helix equal to the electrode helix pitch.

The expansion of the arc in a radial direction is attained due to the force of electromagnetic interaction between the tangential component of the arc current and the longitudinally oriented magnetic field formed by an arc-quenching coil disposed within the cylinder member.

When the electrodes are caused to move in opposite directions the parting of the electrodes takes place and a quenching arc is struck. The electromagnetic interaction between the radial component of the arc current at the areas adjacent the electrodes and a longitudinally oriented magnetic field causes the "winding" of the arc on to the helix-shaped electrodes with the result that the arc assumes the form of a helix.

The quenching arc expands in a radial direction and moves away from the surface of the cylinder member at a location where the helix partition does not give influence on the from of the arc column and on the direction in which the latter is moved and does not resist the occurrence of a breakdown between the adjacent turns of the helix arc. As a result, the arc can be lengthened within specific limits only and the working voltage at which the switchgear operates reliably amounts to a value of several kV, the proper overall size of the apparatus not exceeding 1 m in this case.

The described apparatus is therefore disadvantageous in that the working voltage is low due to a small length of the helix-shaped arc so produced, which is equal to one or more turns. In addition, the electrodes must follow a helix path and must have a helix shape, which results in complex design features of the associated switchgear.

SUMMARY OF THE INVENTION

An object of the invention is to provide an electromagnetic arc extinction apparatus for switchgear, which apparatus can provide for an increase in the working voltage at the given overall dimensions of the switchgear so that its switching time is maintained at a preset level or increased.

Another object of the invention is to provide a relatively simple electromagnetic arc extinction apparatus for switchgear operating at the working voltage exceeding 10 kV.

Still another object of the invention is to provide an electromagnetic arc extinction apparatus for switchgear, which apparatus can be used in different switching devices such as circuit breakers, fuses and electroexplosion trips.

There is provided an electromagnetic arc extinction apparatus for switchgear, comprising two electrodes between which a quenching arc having the form of a helix and expanding in a radial direction is generated, which apparatus comprises, according to the invention, an arc chamber made of an electrically insulating material and adapted to cause the quenching arc to be moved in a radial direction, said arc chamber having a cavity bent along a helix whose pitch is at least 10 times lesser than the diameter of the arc chamber measured over its cross-section, and also comprises an axial channel, said electrodes being aligned with the axis of the arc chamber.

Advantageously, an electromagnetic arc extinction apparatus has an arc chamber whose cavity narrows in a radial direction.

Preferably, an electromagnetic arc extinction apparatus has an arc chamber that comprises fixation members disposed in its cavity and rigidly attached to its walls, with the result that the apparatus is given good robustness, mechanical strength and vibration stability.

Advantageously, an electromagnetic arc extinction apparatus has an arc chamber that includes elements made of an electrically conducting material and adapted to shift the support spot of a quenching arc in a radial direction, said elements being disposed on respective end faces of the arc chamber and electrically connected to respective electrodes which are located on corresponding end faces of the arc chamber, said elements being used to provide for greater service life of the electrodes.

Preferably, an electromagnetic arc extinction apparatus has a first electode allowed to be moved in the axial channel of an arc chamber, the first electrode having a rod made of an electrically insulating material, adapted to resist the occurrence of a breakdown in the axial channel, and affixed to that end of the first electrode which faces a second electrode having an axial hole that accomodates the rod, the length of the latter being selected to be equal at least to the spacing between the two electrodes with the first electrode held in its extreme position.

Advantageously, an electromagnetic arc extinction apparatus has an arc chamber that narrows towards that its end face on which said first electrode is located and is allowed to be moved in the axial channel of said arc chamber.

Preferably, an electromagnetic arc extinction apparatus comprises a fusible, element in the form of a wire that connects two electrodes, and also comprises an arc chamber, said fusible element being disposed in the axial channel of the arc chamber, the diameter of the wire being selected to be equal to that of the axial channel.

Advantageously, an electromagnetic arc extinction apparatus for switchgear comprises a fusible element in the form of a wire that connects two electrodes, and also comprises an arc chamber having an insert made of an electrically insulating material, the insert being disposed in the axial channel of the arc chamber and having its diameter equal to that of the axial channel, and the fusible element being arranged in the form of a helix and disposed on the insert in the cavity of the arc chamber.

The apparatus of the invention provides for a helix-shaped quenching arc whose helix has a small pitch. This ensures a higher compactness of spatial arrangement of the arc and small overall dimensions of the apparatus of the invention which is capable of switching high voltages reaching hundreds of kVs and more and is suitable for a.c. and d.c. applications. The path covered by the arc column during its movement in a radial direction, caused by electromagnetic interaction between the arc current and a magnetic field, is maintained during the switching process at a low magnitude reaching 1 m approximately, with the result that the switching time is high and the apparatus can be operated as a current limiting one during the interruption of short-circuit currents.

A small pitch of the helix of the arc provides for effective use of the magnetic field of the arc current itself, which ensures higher switching time of the apparatus of the invention and simpler design of the associated switchgear since there is no need in some cases for arc-quenching coils and magnetic circuits.

The apparatus of the invention provides for high-voltage heavy-current electromagnetic circuit breakers which are comparable with the present-day competitors known in the art such as oil, small oil volume, air-blast and $SF_6$-filled circuit breakers rated for the voltages of tens and hundreds of kV and more and for currents of hundreds and thousands of A and more. The electromagnetic circuit breakers provide for multiple switching of the controlled circuits and for higher switching time (for example, halfwave current interruption is attained in the case of a.c. circuits). These circuit breakers also offer good reliability and convenient maintenance.

In the case of fuse gear, the apparatus of the invention makes it possible to construct simple, inexpensive and high-speed protective devices of the overall dimensions which can handle working voltages of hundreds of kV and can be operated on a.c. and d.c. circuits; such devices are not known in the prior art.

In addition, the apparatus of the invention can provide for the construction of high-voltage heavy-current trips which fund use in some special cases such as the switching of the induction-type accumulators.

DESCRIPTION OF THE DRAWINGS

The invention will now be described, by way of examples, with reference to the accompanying drawings in which.

DESCRIPTION OF THE INVENTION

The electromagnetic arc extinction apparatus for switchgear, according to the invention, is described in the illustrated embodiment as an arc extinction apparatus intended for a circuit breaker. The practice is to connect the apparatus to the power contacts of a circuit breaker, which serve to carry the current during a time interval between two successive switchings.

The apparatus of the invention comprises an arc chamber 1 (FIG. 1) that includes a cavity arranged to follow a helix and that also includes an axial channel 2. The latter accommodates two electrodes 3,4. The diameter of the electrodes 3,4 is determined by the magnitude of the working current and is equal to the diameter of the axial channel 2. The electrodes 3,4 are usually made of copper, copper/tungsten alloys and the like. The apparatus of the invention also comprises conventional arc-quenching coils (not shown) which are connected, for example, in series with the apparatus. These arc-quenching coils produce the magnetic field B (shown by a respective arrow in the figure) within the arc chamber 1 during the switching process. In the given embodiment, the magnetic field B is oriented in a direction coinciding with the axis of the arc chamber 1 and the electrodes 4, 3 and is, therefore, a longitudinal one.

Figure 1:
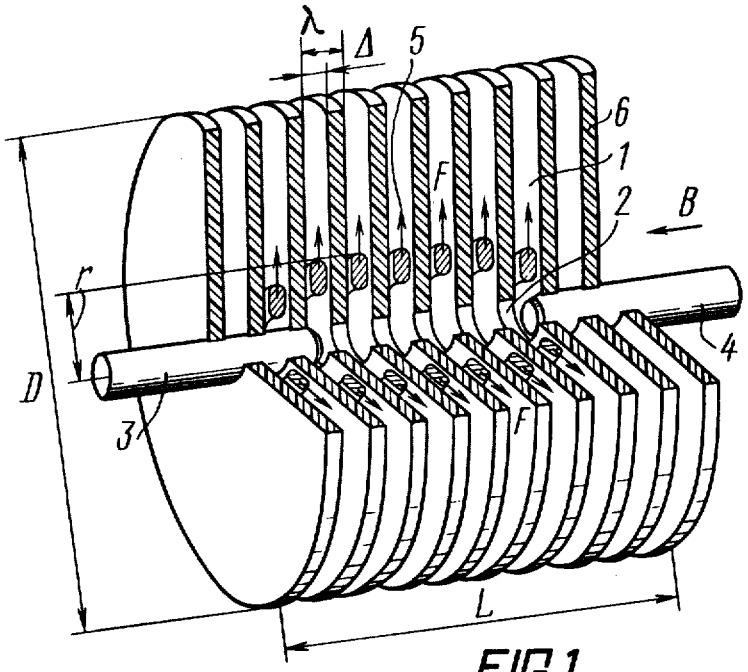
FIG. 1 is a dimetric representation of an electromagnetic arc extinction apparatus for switchgear, according to the invention.

The arc chamber 1 causes a breaking arc 5 having the form of a helix to move in a radial direction. In FIG. 1, r is the current radius of the breaking arc 5 and F is the radial component of the force of electromagnetic interaction between the breaking arc 5 and the magnetic field B, respective arrows being used to show the directions in which the column of the breaking arc 5 is acted upon by that force. The arc chamber 1 is formed by a screwlike body which is a helix blade 6 having the pitch $\lambda$ and adapted to provide said helix cavity of the chamber 1 with the width $\Delta$. The cavity serves as an arc-quenching slit structure of the apparatus. The width of the slit structure and the magnitudes of the current of the quenching arc 5 and of the magnetic field B determine the parameters of the quenching arc 5 as follows: the current density; the size and shape of the arc column and the intensity of the electric field thereof; and the velocity of the arc column. The width of the helix cavity of the arc chamber 1 is usually selected to be equal to 2 to 10 mm.

It is common practice to select the value of the pitch of the helix cavity of the arc chamber 1 as small as possible. It is dependent upon the material, fabrication techniques, operating conditions and service life of the arc chamber 1 and, more specifically, upon a maximum permissible thickness of the helix blade 6 which equals to $(\lambda-\Delta)$. The helix blade 6 or the arc chamber 1 can be manufactured from different electrically insulating materials such as arc-resistant and gas-generating ones. For example, cast plastics including polysulfone, polycarbonate and lavsan can be used for the purpose.

In the given embodiment, the heat load applied to the walls of the arc chamber 1 is less than the thermal load that affects the walls of the known electromagnetic labyrinth-type arc chambers due to the fact that in the former case the arc column moves with a greater velocity (this phenomenon will be explained hereinafter). In addition, the helix blade 6 of the arc chamber 1 is subjected to a relatively small mechanical load since the quenching arc 5 acts upon it from two sides. As a result, the material of the helix blade 6 may possess properties that are inferior to those of the material from which the known electromagnetic labyrinth-type arc chambers are made.

The arc chamber 1 can be manufactured by casting or stamping. It is possible to construct a cheap sectional variant of the chamber comprised of the elements of the helix blade which connect one another.

The absolute values of the diameter D and length L of the arc chamber 1 are determined by the working voltage and switching time of the associated switchgear (see calculation examples given below). The ratio between the diameter D of the chamber 1 and the pitch of the helix cavity must be not less than 10 in order to obtain a sufficient lengthening of the quenching arc 5 which is $10^2$ to $10^3$ times the length L of the chamber 1, which determine the maximum separation between the electrodes 3, 4.

Figure 2:
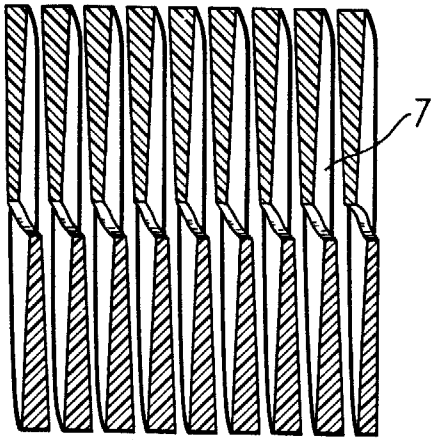
FIG. 2 is a longitudinal section view of an embodiment of the arc chamber of the electromagnetic arc extinction apparatus, the cavity of the arc chamber having its section narrowing in a radial direction, according to the invention.

The helix cavity of the arc chamber 1 (FIG. 1) is a rectangular one. It is good practice, however, to construct the cavity so that it narrows in a radial direction in order to obtain a variation of the intensity of the electrical field of the arc column as the current is decreased during the switching process. FIG. 2 shows an arc chamber 7 whose helix cavity has a trapezoidal section.

Figure 3:
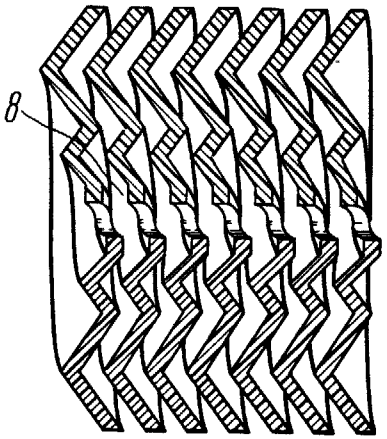
FIG. 3 is a longitudinal section view of another embodiment of the arc chamber of the electromagnetic arc extinction apparatus, the cavity of the arm chamber having a zigzaglike section, according to the invention.

FIG. 3 shows an arc chamber 8 whose helix cavity has a zigzaglike section extending in a radial direction. According to this embodiment, the arc chamber 8 may also have its helix cavity with a variable pitch $\lambda$, which makes it possible to vary the velocity of the arm column. This embodiment is advantageous in that the axial channel 2 (FIG. 1) can be protected from light radiation emitted by the quenching arc 5, that tends to expand in a radial direction, with the result that the electrical strength of the medium contained in the axial channel 2 is restored at a higher rate. In addition, the zigzaglike section of the helix cavity of the arc chamber 8 (FIG. 3) allows the sound effect occurring during the switching process to be reduced.

To provide for mechanical strength, robustness and vibration stability of the apparatus of the invention, it comprises fixation members 9, 10 (FIGS. 4,5) which are disposed within the helix cavity of an arc chamber 11 (FIG. 4) and are rigidly coupled with the walls of the chamber, said walls being formed by a helix blade 12. The arc chamber 11 has an axial channel 13 which accommodates electrodes 14, 15.

The fixation members 9, 10 (FIG. 5) are arranged in two rows in circumferential relation to the arc chamber 11. One of the two rows includes the fixation members 9 made as cylindrical inserts, while the other row includes the fixation members 10 made as ribs.

The fixation members 9, 10 are made of an electrically insulating material, for example, that of which the arc chamber 11 is made, and are fixed, for example, by cementing.

The position and dimensions of the fixation members 9, 10 are dependent upon the materials and fabrication processes used for the manufacture of the members and the arc chamber 11 and must be such that a quenching arc 16 (FIG. 5) is allowed to pass freely around the members. The position of the column of the quenching arc 16 is shown for two successive points in time occupied by the arc in the course of is movement in a radial direction: a is the point in time when the arc passes around the members 9 and b is the point in time when the arc approaches the members 10.

The fixation members 9,10 can be fabricated from metal. In this case, they additionally act as an arc-quenching grid with the result that the parameters of the arc chamber 11 are improved. In this embodiment, the fixation member 9, 10 must be electrically insulated one from another.

In addition, the fixation members can provide a means for coupling separate parts of a sectional arc chamber with an appreciable assembly accuracy.

To allow the support spots of the quenching arc to be moved in a radial direction, additional horn-shaped electrodes are introduced in the arc chamber. These electrodes, made of an electrically conducting material, are oriented in a radial direction at the beginning and end of the helix cavity; the electrodes must be electrically connected to respective main electrodes.

Figure 6:
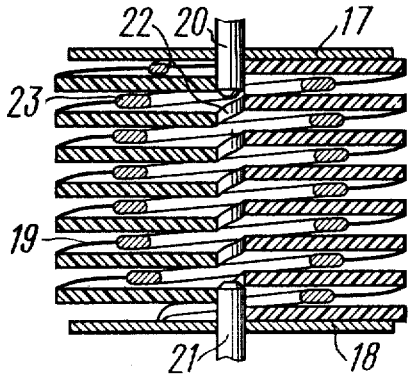
FIG. 6 is a longitudinal section view of the electromagnetic arc extinction apparatus having end face discs, according to the invention.

FIG. 6 shows an embodiment of the apparatus of the invention which comprises elements 17, 18 made of an electrically conducting material and allowing for the movement of the support spots of the quenching arc in a radial direction. The elements 17, 18 are implemented as metallic discs having axial holes and disposed on the end faces of the arc chamber 19. The elements 17, 18 are electrically connected to respective electrodes 20, 21 which are located at corresponding end faces in an axial channel 22. The elements 17, 18 can be fabricated, for example, from copper.

FIG. 6 shows how the quenching arc 23 expands in a radial direction as their support spots move over the elements 17, 18.

Figure 7:
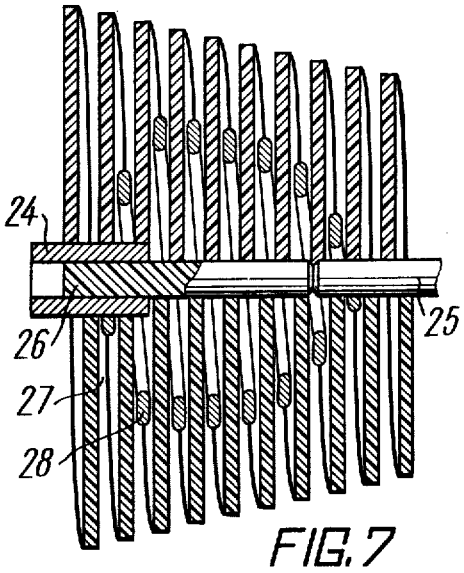
FIG. 7 is a longitudinal section view of an embodiment of the electromagnetic arc extinction apparatus, including a rod made of an electrically insulating material and disposed in the axial channel of the arc chamber, according to the invention.

FIG. 7 shows an electromagnetic arc extinction apparatus for a high-voltage heavy-current circuit breaker. In the given embodiment, an immovable electrode 24 is implemented, for example, as a tubing that has its inner diameter equal to the diameter of a movable electrode 24. There is a rod 26 made of an electrically insulating material and coupled, for example, by thread connection with the movable electrode 25.

The diameter of the rod 26 is equal to the diameter of the movable electrode 25 and has its length at least to the spacing between the electrodes 24, 25 with the electrode 25 held in its extreme position.

The rod 26 provides for a condition where no breakdown occurs between the electrodes 24, 25 which are being drawn apart during the switching process, a feature ensuring reliable operation of an arc chamber 27.

A preferred material for the rod 26 is an arc-resistant and gas-generating one. Since the shape of the rod 26 is simple, various materials such as ceramics, boron nitride and asbestos-cement can be used for the purpose. It is feasible to make the electrode 24, for example, from one or more current-collecting jaws.

Note that the position of a quenching arc 28 in the figure corresponds to a certain point in time during which the apparatus of the invention is operated.

It is preferable to select that outline of the arc chamber 27 which corresponds to the form of the quenching arc 28, caused to expand in a radial direction, which form being attained at the moment when the switching process is terminated. According to one of the embodiments, the arc chamber 27 narrows towards the end face at which the movable electrode 25 is located.

Let us calculate the overall and working dimensions of a circuit breaker which can handle a voltage U of 100 kV and which is operated in conjunction with the apparatus of the invention. Assume that the circuit breaker offers a switching time of 10 ms, which provides for a half-wave interruption in the case of an a.c. circuit being switched. With an average velocity $V_a$ of the arc column equal to 50 to 100 m/s approximately, the permissible height of the slit and, therefore, the diameter D of the apparatus of the invention is given by $$D \approx 2V_2\tau = 1 \text{ to } 2 \text{ m}$$

With an average intensity E of the electric field in the column of the breaking arc being moved equal to 20 to 30 V/cm, the desired arc length $l_a$ is given by $l_a = (-2U/E) \approx 70$ to 100 m, a twofold margin for the turned-off voltage U being selected to take into account an overvoltage condition.

To provide for proper design of the apparatus of the invention, let the pitch λ of the helix blade be equal to 1 cm approximately and the length L of the arc chamber be equal to its diameter D. This gives $$D = L = \sqrt{\frac{l_a\lambda}{\pi}} \approx 0.48 \text{ to } 0.55 \text{ m}$$

Therefore, the arc chamber having the dimensions $D \lesssim 0.55$ m and $L \lesssim 0.55$ m is capable of switching a.c. and d.c. circuits at a voltage U of 100 kV (with a twofold voltage margin) and a switching time $\tau < 0.01$ s. With the apparatus of the invention, there is no need for the following components of modern 100-kV circuit breakers: a reservoir accommodating 6 to 12 tons of oil in an oil circuit breaker, that weighs itself 8 to 15 tons; a reservoir accommodating 0.5 to 1.5 tons of oil in a small volume oil circuit breaker, that weighs itself 4 to 8 tons; a receiver with a compressor rated for 2 to 6 MPa in a compressed-air circuit breaker, that weighs itself 5 to 8 tons; and a hermetically sealed casing rated for 0.3 to 0.6 MPa and filled with an expensive $SF_6$ gas, in a self-blast $SF_6$ circuit breaker, that weighs itself 5 to 8 tons. Note that these modern circuit breakers can provide for a switching time of 0.06 to 0.1 s in the case of a.c. applications only.

Figure 8:
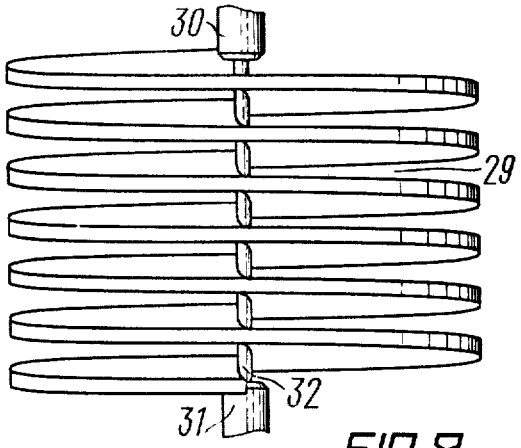
FIG. 8 shows an electromagnetic arc extinction apparatus of fuse gear, according to the invention.

FIG. 8 shows an electromagnetic arc extinction apparatus for a high-voltage fuse. The apparatus comprises an arc chamber 29 made of an electrically insulating material. Immovable electrodes 30, 31 are located in axial relationship to the arc chamber 29 at its end faces and are connected by a fusible element 32 implemented as a wire made, for example, of copper. The fusible element 32 is disposed in the axial channel of the arc chamber 29, the diameter of the fusible element 32 being equal to the diameter of the axial channel.

It is known that fuses are basically intended to protect the associated circuits from short circuit and must therefore offer a shorter switching time. In addition, fuses must be appreciably simple and cheap. Modern high-voltage fuses offer normal operation at voltage levels not exceeding 30 to 50 kV.

The basic component of a fuse is a fusible element that connects immovable electrodes serving in this case as power leads. The ratio between the arc length at the end of the switching process and the length of the fusible element is one of the most critical parameters that influence the design and operation of a fuse.

The high-voltage fuse of FIG. 8 has a maximum permissible value of the above-mentioned ratio due to the fact that a straight fusible element 32 is used which has its length equal to the length of the arc chamber 29.

For example, an arc chamber of a 100-kv fuse (with a twofold voltage margin) has a quenching time of 3 ms at $\lambda = 1$ cm, $E = 25$ V/cm and $V_a = 50$ m/s. In this case, the parameters D.L and ratio $l_a/L$ are determined as follows: $D = 2\ V_a\tau = 0.3$ m, $L = 2U/\pi ED = 0.9$ m, and $l_a/L = 90$.

These dimensions ensure proper technical implementation of an arc chamber for a 100-kV fuse.

Figure 9:
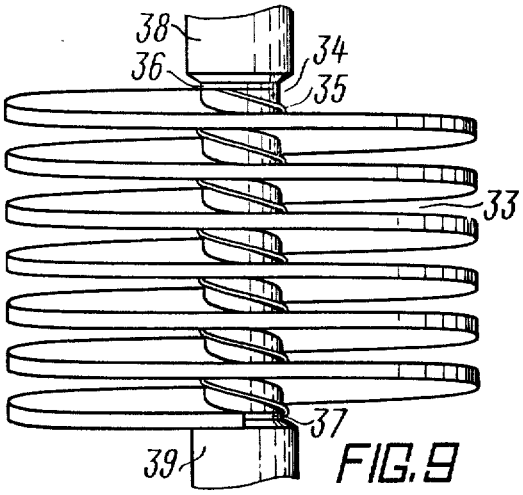
FIG. 9 shows an electromagnetic arc extinction apparatus for fuse gear and electroexplosion trip, according to the invention.

FIG. 9 shows another embodiment of the apparatus of the invention intended for a fuse and an electroexplosion trip, which embodiment comprises an arc chamber 33 whose axial channel accommodates a cylindrical insert 34. The diameter of the latter is equal to the diameter of the axial channel of the arc chamber 33. Wound on the insert 34 is a fusible element 35 having a pitch equal to the pitch of the helix cavity of the arc chamber 33. The insert 34 is made of an electrically insulating material identical, for example, with that of the arc chamber 33. The end faces of the insert 34 have respective metallic discs 36,37 which provide for electric contact between the fusible element 35 and immovable electrodes 38,39 of a fuse or electroexplosion trip.

In the given embodiment, the insert 34 can be replaced after the fusible element 35 has been blown. It is feasible, in the case of fuse application, to allow the insert 34 to be moved along the axis of the arc chamber 33 after the fuse blowing so as to indicate that the circuit is turned off. A new insert 34 with a new fusible element 35 is inserted in the arc chamber 33 and is fixed in a manner that a due space alignment between the fusible element 35 and the helix cavity of the arc chamber 33 is attained.

The arc chamber intended for fuse application can be made a multiturn one and the insert can be provided with several fusible elements equal in number to the number of the turns of the helix cavity of the arc chamber. If a fusible element is blown, the next one can be connected in the circuit by rotating the insert or the arc chamber together with the insert by a certain angle.

The embodiments of the present invention can be used in conjunction with the known methods dealing with arc extinction and employed in electromagnetic switching devices so as to improve the parameters of the latter.

The working medium in the circuit breaker housing can be changed; for example, the latter is filled with the $SF_6$ gas. The pressure within the housing can be varied; for example, the pressure is increased or decreased, or the housing is evacuated, the two latter cases being concerned with an increase in the switching time of the circuit breaker.

The arc voltage can be increased by virtue of arc-quenching and deionizing grids implemented as the sets of insulated plates arranged at the outlet of the arc-quenching slit in a direction of movement of the arc column.

Like conventional electromagnetic arc chambers, the arc chamber of the invention may have its helix cavity arranged in a zigzaglike (labyrinth) fashion along the quenching arc, namely, in a tangential direction, which provides for an additional increase of 1.5 to 3 times in the arc length without considerable increase in the overall dimensions of the arc chambers.

It is known that electromagnetic arc extinction devices cannot work effectively in the case of circuit breaker applications when small currents are interrupted (which means that fast switchings must be effected at a small load). To eliminate this drawback, the arc chamber of the present invention can be provided, like conventional electromagnetic arc chambers, with gas blast which is directed into the helix cavity with the result that a small-current quenching arc is lengthened.

Such a gas blast, for example, an air blast, can be delivered through the axial holes made in the movable and immovable electrodes as well as in the rod of an electrically insulating material, connected with the movable electrode, and can be led into the helix cavity of the arc chamber through evenly distributed radial holes. The blast can also be delivered through the body of the helix blade and led into the cavity through respective holes in the base of the blade in the vicinity of the axial channel of the arc chamber.

The circuit breaker provided with the apparatus of the invention operates in the following manner. After an interrupt control signal is generated, the power contacts of the circuit breaker are separated with the result that the circuit current passes through the electrodes 3,4 (FIG. 1) of the apparatus of the invention.

The quenching arc 5 formed in the axial channel 2 of the arc chamber after the parting of the electrodes 3,4 is surrounded by the longitudinal magnetic field B produced by magnetic-blast coils (not shown). Under these conditions and at specific values of the associated parameters, the arc column changes to a helixlike shape (cf. an article by E. I. Asinovsky, A. A. Afanasyev, E. P. Pakhomov, entitled "Helix Instability of Arc in Longitudinal Magnetic Field" Proceedings of the Academy of Sciences of the USSR, 231, No. 2, 1976). Thus, there result a radial component of the force F of electromagnetic interaction between the arc current and the magnetic field due to the occurrence of the tangential component of the current of the quenching arc 5. That radial component of the force F causes the helix quenching arc to be drawn into the helix cavity of the arc chamber 1 and expand in a radial direction.

In the presence of the longitudinal magnetic field, the radial components of the current of the quench arc 5, existing at the areas adjacent the electrodes, cause a rotation of respective portions of the quenching arc 5 in opposite directions under the action of the tangential components of the force F. The quenching arc 5 is therefore wound on the electrodes 3,4 in the form of a helix determined by the the helix cavity of the arc chamber 1. As a result the rate of rise of the longitudinal size of the quenching arc 5, which expands in a radial direction, is always greater than the rate of parting of the electrodes 3,4.

After the quenching arc 5 reaches the length which allows for the recovery of a voltage across the contacts of the circuit breaker equal to the voltage across the contacts of the circuit being switched, the current drops to zero. At this point in time, the breaking process is terminated.

The making process is effected in a reverse order as follows: first, the electrodes 3,4, of the apparatus of the invention are closed, and then, the power contacts (not shown) of the circuit breaker.

The apparatus of the invention provides for a condition where the quenching arc 5 expands in a radial direction on a stable basis so that no considerable leading or lagging of separate turns of the arc takes place. This is due to the fact that the currents through the adjacent turns act upon one another, i.e., the attraction of parallel currents takes place. In this case, the helix blade 6 of the arc chamber 1 is not subjected practically to mechanical stress since the arc column 5 acts upon it from two sides. Note that an unbalanced condition of the longitudinal component of the force F of interaction of the turns of the breaking arc 5 produce a force that is always directed to the centre of the arc chamber 1.

A first approximation of the characteristics of the apparatus of the invention is given by the following equations. One of them describes the arc voltage $U(t)=\pi r(t)l(t)E/\lambda$, and the other describes the rate of recovery of the arc voltage $\partial U/\partial t=\pi(t)EV_a/\lambda$, where r(t) and l(t) are the current radius and the longitudinal size of the quenching arc 5, respectively.

According to the invention, the inductance of the quenching arc 5 itself must be taken into consideration.

Figure 5:
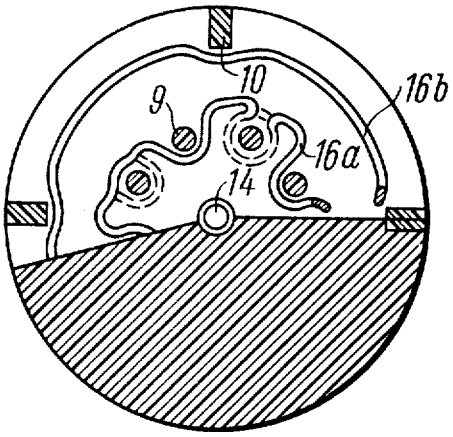
FIG. 5 is a section taken along the line V—V of FIG. 4, according to the invention.
Figure 4:
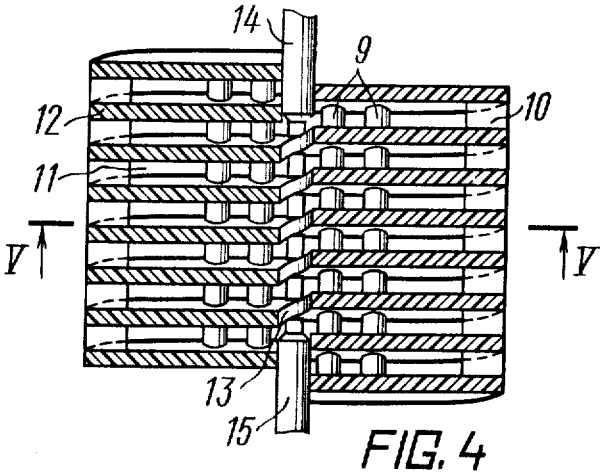
FIG. 4 is a longitudinal section view of the arc chamber of the electromagnetic arc extinction apparatus, having fixation members.

Referring to FIGS. 4,5, there is shown the quenching arc 16 which expands in a radial direction and approaches the fixation members 9 (the position a in FIG. 5) where it is subjected to a bending and passes around the members. At this point in time there result a breakdown between the approaching portions of the arc column **16*a* behind the obstacles passed around, namely, the fixation members 9, with the result that a new helix arc 16*b*** is formed which is practically an undisturbed one.

FIG. 6 shows the arc chamber 19 provided with respective metallic discs 17, 18 on its end faces. In this case, the quenching arc 23 tends to expand in a radial direction as well as in a longitudinal direction (as it is "wound" on the electrodes 20, 21). When the quenching arc 23 approaches the chamber end faces it then appears at the discs 17, 18 and changes to a barrelshaped form which may further become practically cylindrical. Like the case with horn-shaped electrodes, this allows for a reduction of the erosion of the electrodes 20,21.

The apparatus of the invention shown in FIG. 7 is operated in a distinct manner during the first operational step. Here, the rod 26, adjacent the movable electrode 25 and caused to be moved therewith, is introduced into the axial channel of the arc chamber 27 during the parting of the electrodes 24, 25. The resulting arc 28 is drawn immediately into the helix cavity of the arc chamber 27 which connects the separated electrodes 24, 25. As a result, the quenching arc 28 is caused to assume a helix form corresponding to that of the cavity of the arc chamber 27. The rod 26 therefore allows for immediate production of a helix-shaped quenching arc 28 with the result that the intermediate steps of forming and introducing the arc into the helix cavity of the arc chamber are not included in the switching process.

As previously described, the quenching arc 28 so produced tends to expand in a radial direction under the action of the force F and is wound on the electrodes 24, 25, following the path of the helix cavity of the arc chamber 27. Thus, the quenching arc 28 acts upon the rod 26 for a short time interval, which provides for favourable operating conditions of the rod.

Since the quenching arc 28 has a small pitch $\lambda$, it is practically a heavy-current plasma solenoid which produces an additional longitudinal magnetic field B, thereby providing for due operation of the arc chamber 29. This means that the magnetic field of the current of the quenching arc 28 is utilized on a very effective basis. In the example described above, the interruption of a current of 2 and 20 kA with the help of a 10$\theta$ kV apparatus is accompanied by the occurrence of a longitudinal magnetic field obtainable from 55 current turns of the quenching arc, said field amounting to 0.2 and 2 T, respectively, as measured at the axis of the arc chamber. The apparatus of the invention therefore makes it possible to simplify the design of the associated switchgear due to the fact that magnetic-blast coils and magnetic circuits are not necessary in many cases.

There are specific cases concerned with the use of the apparatus of the invention in conjunction with fuses and electroexplosion trips. The embodiment of the invention shown in FIG. 8 is operated in conjunction with a fuse as follows. After the fusible element 32 has been blown, a breaking arc is so formed and the resulting arc column tends to expand at a higher rate during the initial period of the arc formation since plasma conductivity is considerably less than metal conductivity. The arc column can expand only towards the helix cavity of the arc chamber with the result that a helix-shaped quenching arc is produced already during that period.

The helix-shaped breaking arc then expands in a radial direction and is given a considerable lengthening. Under these conditions, the longitudinal size of the arc is held equal to the length of the arc chamber. This provides for an additional increase in the rate of the arc lengthening so that the rate of recovery of the voltage across the contacts of the switchgear is increased too.

After the fusible element 35 (FIG. 9) has been blown, the breaking arc immediately assumes a helix-like shape having a preset radius and pitch. In addition, the current being interrupted creates its own longitudinal magnetic field during the blowing of the fusible element 35. As a result, a greater switching time is attained.

What is claimed is:

1. An electromagnetic arc extinction apparatus for switchgear, comprising:
   - an arc chamber defined by an electrically insulating material and having a cavity extending along a helix so as to allow a quenching arc in the form of a helix to be moved in a radial direction, said cavity having a pitch which is at least 10 times smaller than the diameter of the arc chamber measured over the cross-section thereof;
   - an axial channel extending axially through said arc chamber; and
   - two electrodes at least in part situated in said axial channel and arranged in alignment with the axis of said arc chamber and adapted to form said quenching arc.

2. An apparatus as claimed in claim 1 wherein said cavity of said arc chamber narrows in a radial direction in cross-section.

3. An apparatus as claimed in claim 1 wherein said arc chamber is provided with fixation members disposed in its cavity and rigidly attached to walls defining the same.

4. An apparatus as claimed in claim 1 further including elements adapted to shift the support spots of said quenching arc, said elements being disposed on respective end faces of said arc chamber and electrically connected to respective electrodes which are located at corresponding end faces of said arc chamber, said elements being made of an electrically conducting material.

5. An apparatus as claimed in claim 1, wherein said two electrodes include a first electrode mounted for movement in said axial channel of said arc chamber:
   - a second electrode having an axial hole;
   - a rod made of an electrically conducting material and affixed to that end of said first electrode which faces said second electrode, said rod being disposed in said axial hole of said second electrode and having its length equal at least to the spacing between said first and second electrodes with said first electrode in its extreme position.

6. An apparatus as claimed in claim 5 wherein
   - said arc chamber narrows towards said end face at which said first electrode is located.

7. An electromagnetic arc extinction apparatus for switchgear, comprising:
   - an arc chamber defined by an electrically insulating material and having a cavity extending along a helix so as to allow a quenching arc in the form of a helix to be moved in a radial direction, said cavity having a pitch which is at least 10 times smaller than the diameter of the arc chamber measured over the cross-section thereof;
   - an axial channel extending axially through said arc chamber;
   - two electrodes at least in part situated in said axial channel and arranged in alignment with the axis of said arc chamber and adapted to form said quenching arc; and
   - a wire adapted to connect said electrodes, said wire being disposed in said axial channel of said arc chamber and used as a fusible element, said wire having a diameter substantially equal to the diameter of said axial channel.

8. An electromagnetic arc extinction apparatus for switchgear, comprising:

an arc chamber defined by an electrically insulating material and having a cavity extending along a helix so as to allow a quenching arc in the form of a helix to be moved in a radial direction, said cavity having a pitch which is at least 10 times smaller than the diameter of the arc chamber measured over the cross-section thereof;

an axial channel axially extending through said arc chamber;

two electrodes at least in part situated in said axial channel and arranged in alignment with the axis of said arc chamber and adapted to form said quenching arc;

an insert made of electrically insulating material, disposed in said axial channel of said arc chamber and having its diameter substantially equal to the diameter of said axial channel; and a wire connecting said electrodes, said wire being arranged on said insert in the form of a helix, disposed in said cavity of said arc chamber and used as a fusible element.

9. An apparatus as defined in claim 1 wherein said axial channel is cylindrical and wherein each of said electrodes comprises a substantially cylindrical member extending within said axial channel having respective end faces located within said axial channel in mutually opposed relationship and wherein said electrodes each have an outer diameter substantially equal to the diameter of said axial channel.

* * * * *